United States Patent [19]

Mette et al.

[11] Patent Number: 4,982,562

[45] Date of Patent: Jan. 8, 1991

[54] SPINNING AND TWISTING DEVICE

[75] Inventors: Klaus Mette, Remseck; Helmut Speiser, Weinstadt, both of Fed. Rep. of Germany

[73] Assignee: SKF Textilmaschinen-Komponenten GmbH, Stuttgart, Fed. Rep. of Germany

[21] Appl. No.: 446,388

[22] Filed: Dec. 5, 1989

[30] Foreign Application Priority Data

Dec. 9, 1988 [DE] Fed. Rep. of Germany ..... 3841506

[51] Int. Cl.[5] ..... D01H 7/14; D01H 1/244

[52] U.S. Cl. ..... 57/132; 57/100

[58] Field of Search ..... 57/129–135, 57/100–103

[56] References Cited

U.S. PATENT DOCUMENTS

| | | | |
|---|---|---|---|
| 630,567 | 8/1899 | Sawyer et al. | 57/100 |
| 1,840,642 | 1/1932 | Stone | 57/100 X |
| 2,115,268 | 4/1938 | Klein | 57/100 X |
| 2,940,246 | 6/1960 | Birkigt | 57/132 |
| 3,406,512 | 10/1968 | Stahlecker | 57/132 X |
| 3,447,305 | 6/1969 | Stahlecker et al. | 57/135 X |
| 3,742,694 | 7/1973 | Speiser | 57/132 |
| 4,361,004 | 11/1982 | Hartmannsgruber | 57/129 X |

*Primary Examiner*—John Petrakes

*Attorney, Agent, or Firm*—Bauer & Schaffer

[57] ABSTRACT

A U-shaped latch having a pair of resilient arms is fixed radially and axially in an annular groove formed in the neck of the spindle house. The latch is provided with a projection which passes through a hole in the neck into engagement above a collar integral with the spindle blade, thereby preventing axial movement of the spindle blade. The projection is formed so as to be centered on the inside rim of the latch so that upon radial shifting of the latch, the projection is moved from its engaging position to a disengaging position. The forked latch provides the necessary spring tension to hold the latch in place in either position.

6 Claims, 2 Drawing Sheets

SPINNING AND TWISTING DEVICE

BACKGROUND OF THE INVENTION

The present invention relates to a spinning or doubling device for yarns and, in particular, to a coupling for preventing the inadvertent disengagement of the spindle upon removal of the cop or bobbin.

Textile yarns and fibers are spun or twisted on tubes or rotating spindle blades mounted on spindle shafts. It is often necessary to remove and exchange the cop without disengagement of the spindle, and therefore, a safety coupling mechanism is required to prevent such disengagement.

Such a coupling mechanism is provided between a concentrically arranged spindle bearing housing and whorl in German Pat. No. DE OS 2122963 and its corresponding U.S. Pat. No. 3,742,694 (see FIGS. 5 and 6). This coupling comprises a cylindrical carrier sleeve, fixed the spindle within the throat of the spindle bearing housing having an annular groove formed face on its inner surface. The inner wall of the whorl skirt surrounding the spindle bearing housing is formed with upper and lower radial flanges. A U-shaped latch, having parallel legs with flat inner and outer side edges, is slidable in the annular groove of the carrier sleeve to lie fixed between the flanges, preventing the whorl from moving axially even under high rotational speeds. The latch is prevented from rotation by providing both the spindle and the annular groove with flat surfaces engaging the latch. However, since the distance between the ends of the legs of the latch is slightly shorter than the distance between the flat edges, the ends of the legs abut the inner circumferential surface of that part of the annular groove remaining cylindrical in shape.

Consequently, in order to provide the proper spring tension on the latch, a special leaf spring is inserted in the skirt of the whorl. The middle section of the leaf spring presses against the cylindrical surface of the annular groove, while its two ends rest against rounded protrusions on the inside edge of the central bridge. The outer edge of this combination of spring and bridge forms a safety mechanism, preventing dislodgement of the latch. To release this safety, pressure is applied to the outer edge of the connecting bridge by means of a pin that is inserted through a hole in the whorl skirt. The latch is thus moved opposite to the force of the leaf spring within the groove until the outer edge releases the flanges.

This bipartite safety mechanism thus requires guidance means inside the annular groove as well as other means for its assembly in the annular groove. It can also be released only when the top and bottom parts of the spindle are in a certain position relative to each other.

The present invention is predicated on the task of producing a simpler safety mechanism with respect to its design, assembly, and manipulation.

The foregoing objects and advantages as well as others will be seen from the following disclosure.

SUMMARY OF THE INVENTION

According to the present invention a safety coupling guarding against the inadvertent disengagement of the axially arranged spindle blade and spindle bearing housing is provided. A U-shaped latch having a pair of resilient arms is fixed radially and axially in an annular groove formed in the neck of the spindle housing. The latch is provided with a projection which passes through a hole in the neck into engagement above a collar integral with the spindle blade, thereby preventing axial movement of the spindle blade. The projection is formed so as to be centered on the inside rim of the latch so that upon radial shifting of the latch, the projection can be moved from its engaging position to a disengaging position. The forked latch provides all the necessary spring tension to hold the latch in place in either position.

Placement of the latch in the disengaging position, in which the projection disengages from the annular collar of the spindle blade, is carried out by spreading its fork-shaped ends by radially shifting the latch a short distance. The radial movement is easily performed manually or by use of a tool engaging at the outer rim of the latch.

According to the invention, the tool is a key-like member having a handle at the end of which is an angular pin insertable in a keyhole-like opening. Upon the turning of the handle, the latch can be shifted within a defined path, releasing or causing the latch to engage. As the coupling is arranged inside the housing, it therefore does not require an annular groove fashioned inside the whorl, and the mechanism is especially suited for the use on spindles with individually driven electric motors. In this case an annular collar can be formed on the shaft of the spindle blade which can then be covered. According to the invention, the site for actuating the rotation-safe latch is easily determined about the neck of the casing. However, differing advantageously from the known prior art, the coupling can be actuated in a random rotary position between the upper and lower part of the spindle.

The invention is explained hereinafter with the aid of an example of a spindle drive individually by an electric motor.

Full details of the present invention are set forth in the following description and illustrated in the accompanying drawings.

DESCRIPTION OF THE INVENTION

Figure 1:
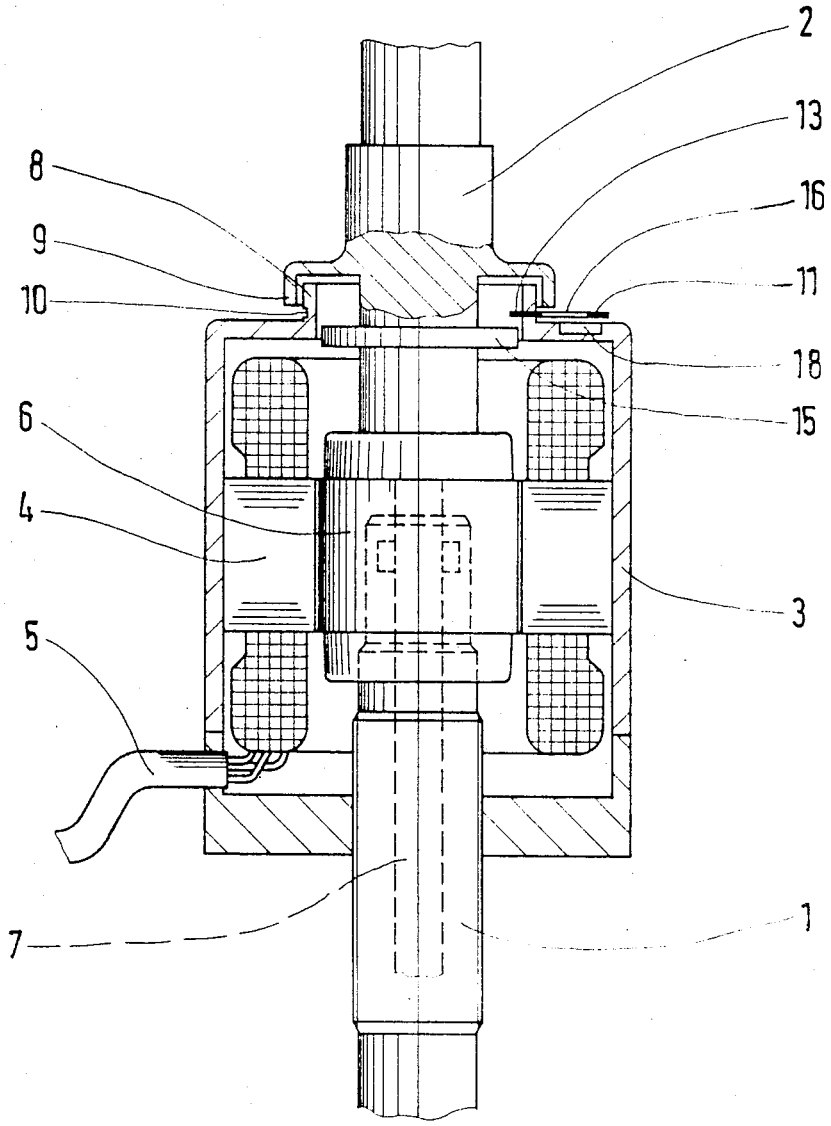
FIG. 1 is a side elevational view, partially in cross-section of a spinning or twisting device having a spinning mechanism driven by a single electric motor.

In FIG. 1 the spindle mechanism has a lower spindle bearing housing 1 onto which a spindle blade 2 has been mounted. The spindle bearing housing 1 and spindle blade 2 are located concentrically in a hollow casing 3 in which the stator 4 of an electric motor is also mounted, the latter being supplied with current by a connecting cable 5. The rotor 6 of the electric motor is force fit on an inner spindle rod 7 (shown in broken lines). The rotor 6 is bell shaped and surrounds the upper part of the lower spindle bearing housing 1.

The casing 3 is provided with an annular neck 8 at its upper end through which the upper spindle blade 2, together with the motor and the spindle rod 7, is inserted. In operation the neck 8 is covered by a cap 9 integral with the spindle blade 2.

Figure 2:
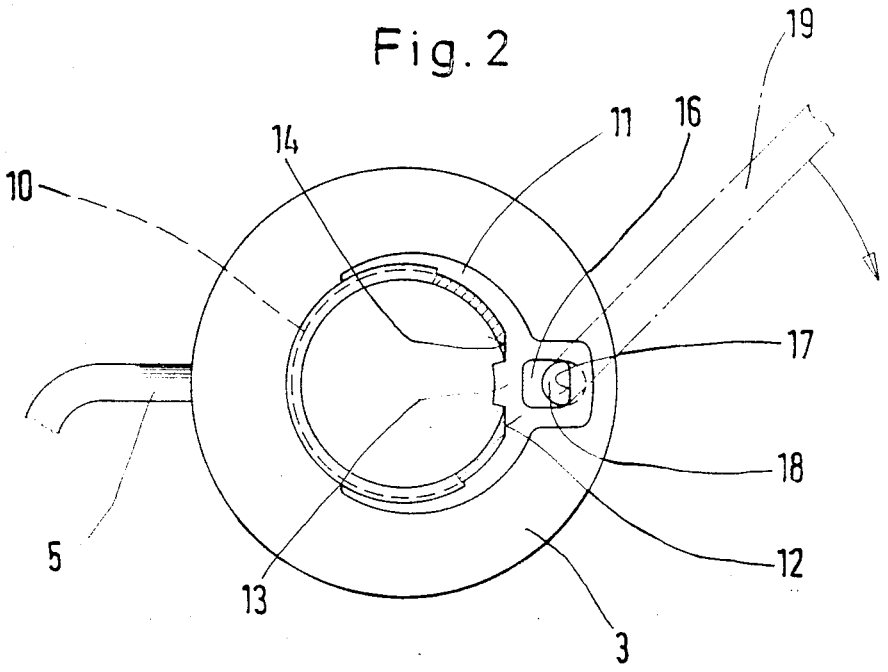
FIG. 2 is a sectional view taken along lines II—II of FIG. 1, with the spindle blade removed.

Formed on the exterior wall of the neck 8 is an annular groove 10 onto which a fork-shaped, plate-like latch 11 having arcuate legs 11*a* (FIG. 2) is radially slideable. The legs 11*a* of the latch are elastically spreadable to snap, as can be seen from FIG. 2, onto the annular groove 10 so that its inner rim maintains close contact with it. The annular groove 10 is formed with a chordal surface 12 during formation of which a breach defining a hole 12*a* is created in the wall of the neck 8. The latch 11 is formed with a radial salient or projection 13 centered on its inside rim so that it can radially project into the hole 12*a* formed by the breach in the groove 10. The inner edge of the latch 11 on the lateral sides of the projection 13 is formed as a plane edge 14 adapted to abut squarely against the chordal surface 12. The close contact of the plane edge 14 with the chordal surface 12 results in a rotation-proof seat, while the location of the hole 12*a* provides an exactly defined position for the latch relative to the casing 3.

As seen in FIG. 1 the inserted projection 13 overlaps an annular collar 15 integrally fixed on the shaft of the spindle blade 2, as a result of which the projection bars axial movement of the spindle through the neck 8. Thus, when changing a cop, the spindle blade 2 and the inner spindle rod 7 are prevented from being lifted off of the spindle bearing housing 1. On the other hand, the latch must be disengageable from its operative position with respect to the collar 15 so that the spindle blade 2 can be lifted out from the casing for access to the motor parts when cleaning and replacement is necessary. For this purpose, the rotor 6 and the collar 15 have approximately identical outer diameters which are less than the opening of the neck 9, and the latch is shifted outwardly to permit the spindle blade and rotor to be easily lifted out of the casing 3.

In order to efficiently effect the radial shifting of the projection 13, the latch 11 is provided with a tab 16 in alignment with the projection 13. The tab 16 is formed with a generally rectangular aperture 16*a*, having a straight edge 17 at its outer end. A shallow circular recess 18 is formed in alignment with the breach in the neck 8 on the shoulder of the casing 3. The parts are formed so that in the securing position illustrated in FIG. 1 the radially inner half of the tab 16 rests freely over the shoulder of the casing 3 such that the inner half of the aperture 16*a* overlies the shoulder adjacent the neck 8, while in contrast the outer half of the tab 16 lies over the recess 18 and occludes part of the recess, the edge 17 running transversely across the center of the recess 18.

Figure 3:
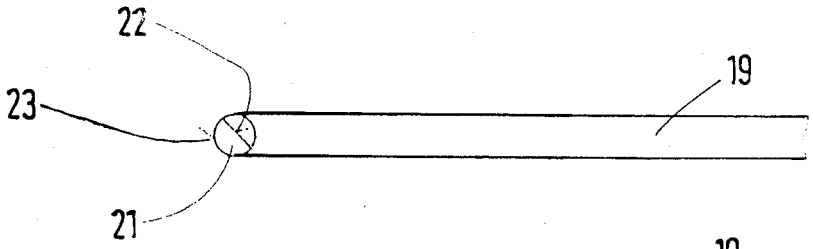
FIG. 3 is a bottom plan view of the latch adjusting tool.
Figure 4:
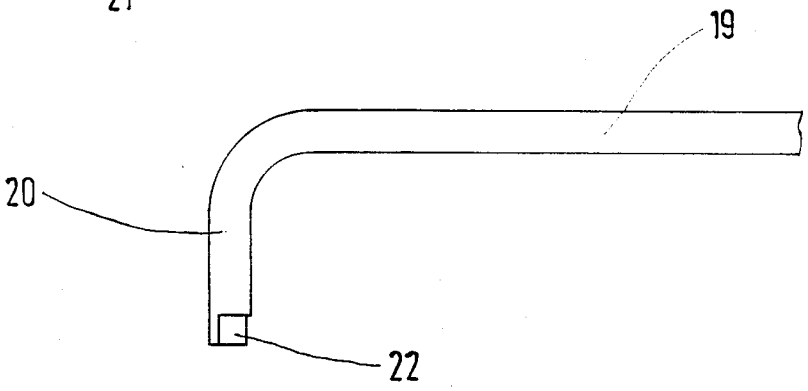
FIG. 4 is a side elevational view of the adjusting tool of FIG. 3.

A key-like adjusting tool useable to manipulate the latch 11 is illustrated in FIGS. 3 and 4. The tool comprises an L-shaped handle 19 having an angularly extending short leg 20 at the end of which a semicircular pin 21 is formed to correspond to the uncovered portion of the recess 18 and adapted to enter through the aperture 16 into the recess 18 as indicated in dash-dot lines in FIG. 2. The flat surface 22 of the pin 21 is cut at an angle to the longitudinal axis of the handle 19 so that when the tool is turned in the direction of the arrow A or opposite to it, the pin 20 turns in the recess 18, and one or the other corner edge of the flat surface 22 acts on the straight edge 17 of the aperture 16 and radially displaces the latch 11 due to the counteraction with the edge 17. Movement of the latch occurs opposite to the inherent bias created by spring force required to spread the fork ends of the latch as it slides on the annular groove 10. The radial movement of the latch 11 ends after the handle 19 is rotated about 90 degrees and when the full arc of the cylindrical outer surface 23 comes into contact with the edge 17. The adjusting tool maintains the latch 11 in this disengaging position relative to the groove 10, although the fork ends still grasp about the annular groove 10 sufficiently so as to provide a secure seat for the latch—that is, the latch always remains engaged in the groove 10 whether shifted in or out of the breach.

Upon counter rotation of the handle or its removal from the aperture 16 the forked ends have sufficient residual bias to cause the latch to move radially inward and automatically seat in the groove 10 in securing position. The tool may likewise be pulled or pushed to shift the latch. In any event, the cooperation of the pin 21 of the tool and the recess limits the stroke by which the latch can be shifted as well as its direction so that complete removal of the latch is prevented.

The simply designed coupling pursuant to the invention allows the latch to be formed as a stamped part. It does not require a special spring to obtain the elastic, radial mounting of the latch in the annular groove, and it can be inserted, simply and rapidly, radially into the annular groove by spreading the fork-shaped ends and finally snapping the latch into place. The annular groove needs to be merely chordally cut to provide a breach in the neck, creating the hole to allow the projection entry into the area above the spindle collar.

A nonrotatable seat is provided for the latch by the combination of its projection and associated flat edges engaging the neck. The present invention additionally provides the advantage of an especially precise seat on the collar by requiring entry of the projection in the breach.

Since the adjusting tool is simple and small, it can be easily supported on the spindle and kept rotatable within a limited degree in a recess on the housing. As a result, unnecessary, excessively large adjusting movement is avoided, and the complete withdrawal of the latch from the annular groove is avoided. The shape of the recess, in which the tool is received, is determined by the form and shape of the adjusting tool to be used. The radial directed recess formed on the surface of the housing is most practical for a tool used as a drawing or shifting hook. The radial length of the recess limits the required drawing path and prevents any possible complete withdrawal of the security member from the mechanism. The latch can be shifted radially in its seat only so far as is required for disengagement by the operation of the rotary adjusting tool.

Various modifications and changes have been shown herein. Others will be obvious to those skilled in the art. Consequently, it is intended that the preceding disclosure be taken as illustrative and not limiting of the invention.

What is claimed is:

1. A spinning or twisting machine comprising a spindle bearing housing and spindle blade a surrounding casing provided with a neck through which the spindle blade axially passes for housing said spindle bearing and spindle blade, a collar integrally formed on said spindle below said neck, an annular groove formed in the exterior surface of said neck and having a hole extending radially therethrough, and a fork-shaped latch resiliently slideable in said groove having a projection extending inwardly through the hole in said groove to lie in opposition to the collar on said spindle blade to thereby prevent axial movement of the spindle blade through said neck.

2. The machine according to claim 1 wherein said neck is provided with a chordal surface breaching said annular groove and forming the radial hole therein, and said latch is formed with flat edges laterally of said projection for abuttment against said chordal surfaces.

3. The machine according to claim 2 wherein said latch is U-shaped and the legs thereof conform to the shape of the annular groove and are resiliently formed to snap over said groove.

4. The machine according to claim 1 wherein said latch is provided with a tab extending outwardly opposite said projection for manipulation of said shaft reciprocally in the radial direction.

5. The machine according to claim 4 wherein said tab is provided with an aperture having a straight inner edge on the side of the aperture away from said projection, said casing having a shoulder adjacent said neck and a recess in said shoulder at least in part aligned with the aperture in said tab, and a tool insertable within said aperture and recess for moving said latch.

6. The machine according to claim 5 wherein the recess is circular in shape and is arranged so that when said latch is in its innermost engaging position, half of said recess is covered by the outer end of said tab, and the straight edge of said aperture is centered over said recess, and said tool having an end corresponding to the exposed portion of said recess and being rotatable therein to shift said latch relative to said neck.

* * * * *